United States Patent [19]

Duce

[11] Patent Number: 4,744,276

[45] Date of Patent: May 17, 1988

[54] METHOD AND APPARATUS FOR PRODUCING PUNCHED TUBE

[75] Inventor: Edward C. Duce, Liversedge, England

[73] Assignee: Stockrail Services Limited, West Yorkshire, England

[21] Appl. No.: 885,726

[22] Filed: Jul. 15, 1986

[30] Foreign Application Priority Data

Jun. 18, 1986 [GB] United Kingdom ..... 8614808

[51] Int. Cl.[4] ..... B21D 28/04; B21D 28/28

[52] U.S. Cl. ..... 83/50; 83/54; 83/179; 83/184; 83/188; 83/195; 83/228

[58] Field of Search ..... 83/54, 188, 184, 195, 83/178, 179, 228, 50

[56] References Cited

U.S. PATENT DOCUMENTS

| | | | |
|---|---|---|---|
| 517,171 | 3/1894 | Saltzkorn et al. | 83/228 |
| 877,855 | 1/1908 | Murray | 83/184 |
| 1,513,100 | 10/1924 | Frederick | 83/188 X |
| 3,288,010 | 11/1966 | Rutz | 83/195 X |
| 3,489,045 | 1/1970 | Ray, Sr. | 83/188 |
| 3,747,450 | 7/1973 | Hudson | 83/188 X |
| 4,426,899 | 1/1984 | Long et al. | 83/188 |

FOREIGN PATENT DOCUMENTS

| | | | |
|---|---|---|---|
| 619883 | 3/1949 | United Kingdom | 83/228 |

*Primary Examiner*—Frank T. Yost
*Attorney, Agent, or Firm*—Fred Philpitt

[57] ABSTRACT

This invention provides a method of and apparatus for punching apertures in the walls of square sectioned steel tube. An elongated square sectioned mandrel is supported horizontally by and is connected at a rear end to roller decking so that a square tube can be fed onto the mandrel and can be used to feed the tube off the mandrel step by step, while between steps the tube is punched at the front end of the mandrel by a punch die on a punch head which moves laterally of the mandrel and into a punch recess in the mandrel. The punch head also has a guide pin which engages a guide recess in the mandrel before the punch die engages the punch recess to ensure that the punch die and punch recess are accurately aligned and that the apertures will be evenly spaced along the length of the tube.

9 Claims, 3 Drawing Sheets

METHOD AND APPARATUS FOR PRODUCING PUNCHED TUBE

This invention relates to a method of and apparatus for producing punched tube, being typically tube which is used for posts or uprights in a racking system comprising the posts or uprights and cross bars and cross connectors.

Such racking systems may be used for example as support shelving structure, hanging structure for articles and goods and general warehousing.

The posts of such racking systems are required to have apertures therein for the receipt of cross bars, fastening device, clips, clamps and so on for the connection and mounting of the cross connecting members, and it is usual to provide such posts by initially puching the apertures in flat strip material, typically flat strip steel, and then by forming the steel into angled or channel form.

By using this known process to produce the posts, there is a limitation on the configuration of post which can be used. Thus, it has not been possible to use this method of manufacture for posts of tubular construction. For posts of tubular construction, there have been difficulties in the punching of the apertures in the tube walls.

This invention relates to a method of and apparatus for punching apertures in the walls of tubes, to produce for example the posts of racking systems, but as will be appreciated as the description proceeds, the invention can apply to the punching of holes in tubes which are required for any suitable purpose.

In the provision of punched tubes for racking systems, it is preferred that the tube be of square section, and that apertures be punched in all faces of the tube, at least over a portion of the length. Punching of apertures in all cases provides the tube with maximum flexibility as to location for connection with a cross bar insofar as it can be arranged that the cross bars can be connected to or linked to any face of the tube. Specifically, in the manufacture of the tube according to the invention, the apertures on opposite faces are aligned so as to permit the cross bars to pass directly through the tube at right angles thereto, but the respective apertures on their respective faces are staggered throughout the length of the tube.

In accordance with the method of the invention for the punching of apertures in tubes, a mandrel is located inside the tube and is operatively arranged in relation to a punch head, said punch head having a die which punches the apertures in the tube by passing through the tube and into a recess in the mandrel, and wherein the tube is fed progressively over the mandrel so that the punch head can be operated cyclically in order to punch a line of apertures in the tube.

Preferably, the punch head has a guide and the mandrel has a guide aperture into which the guide locates prior to the engagement of the die with the tube in order to ensure that prior to the punching operation the die and the recess in the mandrel will be aligned for the punching operation.

The guide and guide aperture may be of such configuration that the guide will pass through a previously formed aperture in the tube other than during the first punching operation to form the first aperture of the line of apertures.

Where the tube is of square section, the mandrel also preferably is of square section, and may comprise a long guide bar having one end fixed. The tube to be punched is fed over the mandrel in one direction and over the end remote from the fixed end, and when the tube is in position the punching operation commences and after each punching operation the tube is fed step by step off the mandrel in a direction opposite to that in which it was placed on the mandrel.

The tube may be fed off the mandrel by automatically or manually operated means, and in one arrangement a pusher tube is slidable on the mandrel and abuts one end of the tube being punched, said pusher tube being connected to a reach of drive chain which is an endless member trained over spaced sprockets or gear wheels. A manually operated gear transmission assembly may be drivingly coupled to one of the sprockets or gear wheels so that by manually turning the said transmission assembly, the pusher tube can be moved on the mandrel and can push the tube being punched progressively off the mandrel.

Any conventional press may be used for the punching operation but of course it will require to be of sufficient rating to perform the punching operation.

It will be understood that the apparatus described can be used for punching apertures in each side of a square section tube, because as each side is completed, the tube is simply removed from the apparatus and turned through 90°, 180° or 270° to punch any of the other three faces.

In order to ensure that the apertures will be punched in the correct position in each phase, there may be two marker guides or gauges mounted on a guide box through which the mandrel passes, and by which the position of the end of the tube to be punched can be set prior to punching apertures in any particular side of the tube. Preferably, the gauges define two different datum positions the apertures in the respective opposite pairs of walls of the tube will be in the same positions lengthwise of the tube, and therefore one guide only is required for each pair of faces.

The apertures will be pitched at the same pitch on each face of the tube, and that pitching will also be equal to the pitching between the punch die and guide on the punch head.

The mandrel may be surrounded in the region of that portion which has the recesses for receiving the punch die and punch guide, with said guide box, the guide box carrying rollers for engaging the outer surface of the tube as it passes over the mandrel, in order to ensure as frictionless a movement over the mandrel as possible.

In a specific example, the punch head is adapted to move vertically, the mandrel being disposed horizontally, and being supported for example on roller decking which again facilitates the frictionless movement of the tube over the mandrel.

An embodiment of the present invention will now be described, by way of example, with reference to the accompanying drawings, wherein.

Figure 1:
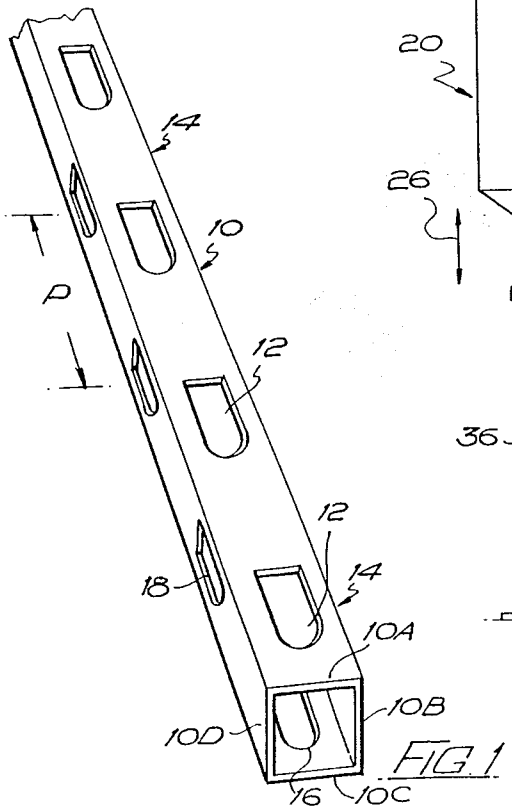
FIG. 1 is a perspective view of a length of tube punched by the method and with the apparatus according to the invention.

Referring to the drawings, and firstly to FIG. 1, this figure shows a steel tube 10 of square cross section and which is suitable for use in connection with a racking system in which the tube is used as one of the posts or uprights of the racking system. Tube 10 has four faces 10A, 10B, 10C and 10D which are provided with punched apertures 12 in face 10A, 14 (not visible in FIG. 1) in face 10B, 16 in face 10C and 18 in face 10D. The apertures 12 in face 10B are aligned with aperture 16 in face 10C, and apertures 14 in face 10B are aligned with apertures 18 in face 10D. The apertures 10, 14, 16 and 18 may extend for the whole length of tube 10, or only for a portion of such length as required. The apertures 12, 14, 16 and 18 are evenly pitched by a pitch length P along the length of the respective faces, and pairs of apertures 14 and 18 are staggered lengthwise of the tube 10 relative to the pairs of apertures 12 and 16.

Figure 2:
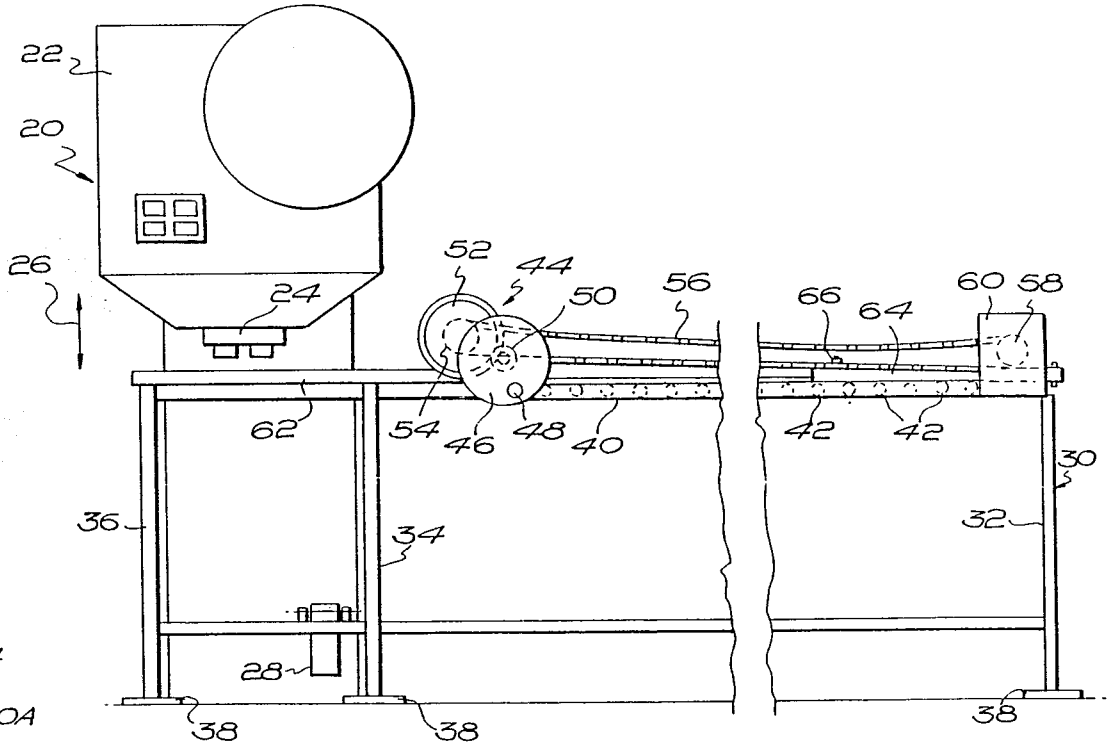
FIG. 2 is a side elevation of the appartaus usable for punching the tube shown in FIG. 1.

The present invention is concerned in the embodiment to be described with the punching of the apertures 12, 14, 16 and 18 in the tube 10 and for this purpose there is provided a machine indicated generally by the numeral 20 in FIG. 2.

Referring to FIG. 2, the machine 20 comprises a power punch 22 having a punch head 24 which is movable as indicated by the arrow 26 in a vertically up and down fashion, upon the operation of a foot pedal 28 accessible to an operator who sits at the front of punch 22 to operate the machine.

The machine 20 also includes a framework 30 comprising upright legs 32, 34 and 36, at the bases of which are support feet 38. The tops of the uprights 32, 34 and 36 are connected by a top decking 40 which is provided with rollers 42 spaced there-along so that the rollers 42 lie with their axes horizontal and parallel. The decking 40 also supports a gear transmissison 44 comprising a hand wheel 46 having a handle 48 by which the hand wheel 46 can be rotated about its axis. Co-axial with and fast with hand wheel 46 is a first gear pinion 50 which drivingly engages a gear wheel 52 rotatable about an axis parallel to the axis of hand wheel 46. Gear wheel 52 is a co-axial with and drivingly connected to a first sprocket 54 around which an endless chain 56 is trained. Considering upright 36 to be at the front end of the machine, and upright 32 at the rear end of the machine, the chain 56 passes over a second sprocket 58 at the rear end of the machine and supported on mounting blocks 60 at said rear end. The gear transmission 44 is towards the front end of the machine, and it will be understood from FIG. 2 that the length of the machine section between upright 34 and upright 32 is substantial compared to that between upright 34 and upright 36 so as to accommodate long lengths of post 10.

The decking 40 and in particular the rollers 42 thereof support a long square section mandrel 62 which is of such a size as to fit neatly into the interior of a tube such as a tube 10 placed thereon. The mandrel 62 passes through a drive sleeve 64 which is secured to the lower reach of the chain 56 by a fixing means 66 which may comprise a nut and bolt arrangement, as shown more clearly in FIG. 3.

The drive sleeve 64 is slidable on the mandrel 62 and it will be appreciated therefore that when the hand wheel 46 is turned using the handle 48, the chain 56 will be driven in either direction depending upon the direction of rotation of the hand wheel 46, and the sleeve 64 will be moved over the length of the mandrel 62 to an extent equal to the spacing between the sprockets 54 and 58.

The mandrel 62 at the rear end is mounted for limited pivotal movement on a pivot bolt 68 carried by a mounting block 70 at the rear of the machine. This is the only location where the mandrel 62 is connected to the machine and it is otherwise free so that a long length of tube 10 can be pushed over the mandrel in order to be punched as indicated in FIG. 1.

Figure 3:
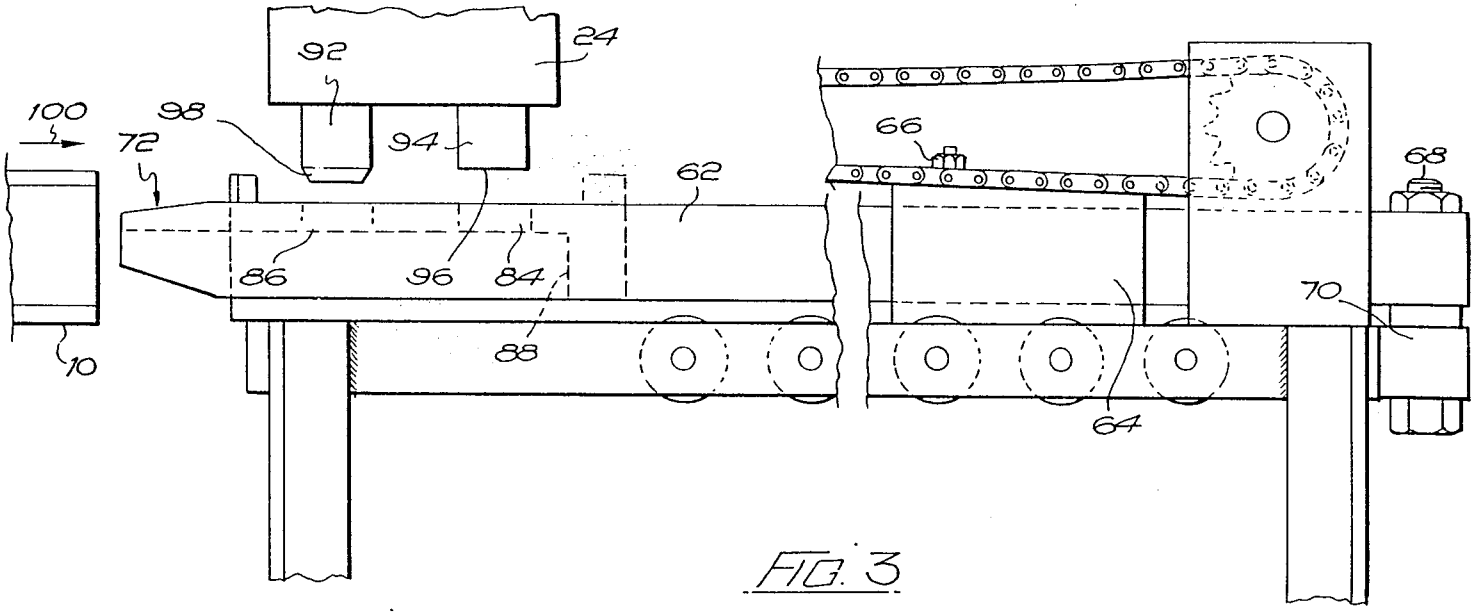
FIG. 3 is an enlarged side elevation of part of the apparatus shown in FIG. 2.
Figure 4:
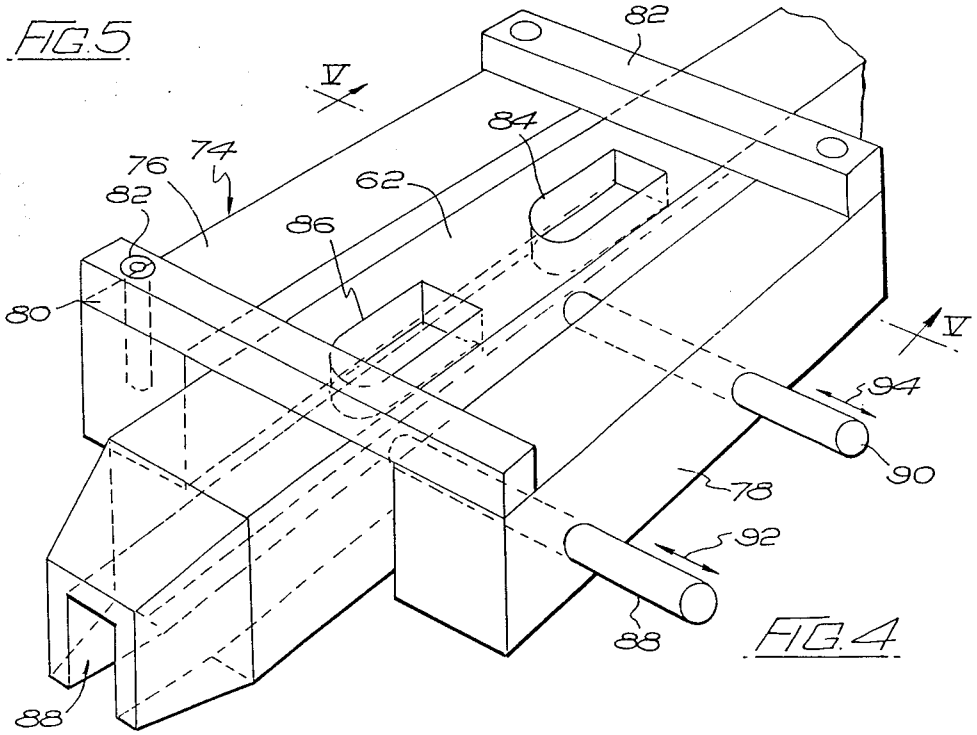
FIG. 4 is a perspective view of a guide box arrangement using the apparatus as shown in FIGS. 2 and 3.

To this end, the front end of the mandrel 62 is tapered as shown at 72 and as shown in FIG. 3 can receive a tube 10 to be pushed thereover. In practice the tube 10 is pushed over the end 72 until it engages the drive sleeve 64 and placement of the tube 10 over the mandrel 62 continues until the drive sleeve 64 is in its most rearward position, for example as shown in FIG. 2. The machine will be designed so that when the drive sleeve 64 is in its rearmost position, the tube 10 will in fact be clear of a front portion of the mandrel located under the punch head 24. This front portion of the mandrel 62 is shown in greater detail in FIG. 4, which figure also shows that surrounding the front portion of the mandrel 62 is the guide box 74 made up of a pair of spaced guide blocks 76 and 78 between which the mandrel 62 passes with clearance as shown. The blocks 76 and 78 are secured together by cross bars 80 and 82 screwed to the blocks 74 and 78 by means of screws 82. FIG. 4 shows that the top face of the mandrel 62 is provided with apertures 84 and 86 spaced by the pitching P illustrated in FIG. 1, and to the underside the mandrel is recessed as shown at 88 and the apertures 86 and 84 lead to the recess 88.

The block 78 is provided with a pair of gauge pins 88 and 90 which can slide relative to the block 78 as indicated by arrows 92 and 94 so that the inner ends of such pins 88 and 90 can be caused to abut the side of the mandrel 62 or can be removed therefrom.

The punch head 24 is provided with a guide pin 92 and a punch pin 94 which are of the cross section which is the same as the apertures 84 and 86, and also the apertures 12, 14, 16 and 18 in the tube 10, and the guide pin 92 and the punch pin 94 are spaced by the said pitching P. As can be seen in FIG. 3, the guide pin 92 is in alignment with aperture 86 in the mandrel, whilst the punch pin 94 is in alignment with the aperture 84. The punch pin 94 has a flat punching face 96 whilst the guide pin 94 is chamfered as indicated at 98 in order to provide a "lead-in" into the aperture 86. It is also to be noted that the guide pin 92 projects further from the punch head 24 than does the punch pin 94.

Figure 5:
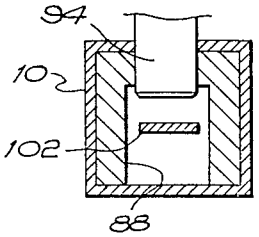
FIG. 5 is a sectional elevation through the mandrel taken on the line V—V of FIG. 4, and showing the tube to be punched and the punching process of the punching operation.

The modus operandi of the machine will now be described. A tube 10 to be punched is fed onto the mandrel as indicated by arrow 100 in FIG. 3, the gauge pins 88 and 90 being retracted to allow this to take place and this feeding on continues until the tube 10 abuts the drive sleeve 64, and that sleeve is moved to its rearmost position in the machine. The length of tube 10 is selected so that when it is in this position on the mandrel, the forward end of the tube is clear of the guide box 74. The operator now decides on the position of the apertures to be formed in the tube i.e. whether the apertures are to be positioned in the tube face in accordance with the position of apertures 12 and 16 or whether the position is to be in accordance with the position of apertures 18 and 14, and he pushes inwardly the appropriate pin 88 or 90 until it contacts the side of the mandrel 62. Next the tube 10 is fed along the mandrel from rear to front of the machine using the transmission 44 as described herein until the forward end of the tube 10 abuts the appropriate gauge pin 88 or 90. The press is then stroked by depression of the pedal 28 so that the punch head 24 moves downwardly. The pin 92 engages the aperture 86 in the mandrel front end thereby bringing the pin 94 and aperture 84 in exact register but before pin 94 moves into recess 84. With continued downward movement of the punch head 24, the pin 94 punches a blank out of the appropriate face of the tube as indicated in FIG. 5, the blank being indicated by reference 102. The blank falls into the recess 88 and eventually rests upon the inner surface of the opposite side of the tube 10. The operator now removes the appropriate pin 88 or 90 so that the tube 10 can be advanced by rotation of the hand tool 46, and the tube is advanced until the previously formed aperture is in alignment with the pin 98 when the press is again stroked. In this stroke of the press the pin 92 passes through the previously formed aperture before once more entering the aperture 86, and therefore not only is the punch pin 94 and the aperture 84 brought into exact register once more, but te correct pitching between the previously formed aperture and the aperture to be formed by this punching stroke is accurately established. This process is repeated until the required number of apertures have been formed into tube face. When the required number have been so formed, the tube is retracted from the mandrel in a direction opposite to direction 103, the accumulated blanks 102 inside the tube are discharged, and then the tube is rotated through 90°, 180°, or 270° and is replaced on the mandrel for the punching of the appropriate face. The achieve the staggering of the apertures as indicated in FIG. 1 on the opposite pairs of faces, the pins 90 and 88 are used accordingly.

The method and apparatus of the embodiment described permits the rapid and accurate punching of apertures such as 12, 14, 16 and 18 in a square tube 10. The method can be used for the punching of apertures in the tubes of different cross section but appropriate mandrels would have to be provided.

I claim:

1. A method of punching apertures in tubes of square cross section comprising the steps of:

(a) placing the tube over a mandrel of corresponding section;

(b) moving a punch transversely of the tube and into a punch recess in the mandrel to punch a first aperture therein;

(c) moving the tube relative to the mandrel by a predetermined amount;

(d) moving the punch transversely of the tube to punch a second aperture therein spaced from the first aperture by said predetermined distance;

(e) repeating steps (c) and (d) to produce a line of evenly spaced apertures in one side of the tube; and after the first line of apertures has been provided in such one side of the tube:

(f) removing the tube from the mandrel;

(g) turning it about its axis by 90°;

(h) repositioning the tube on the mandrel; and (i) carrying out and repeating steps (c) and (d) to provide a second line of apertures being staggered, lengthwise of the tube, relative to the first line of apertures.

2. A method according to claim 1, wherein the tube is placed over the mandrel by being fed in a first direction and is moved relative to the mandrel between punching steps in the opposite direction.

3. A method according to claim 1, wherein during each punching stroke a guide pin engages a guide recess in the mandrel prior to each punching step in order accurately to align the punch and punch recess.

4. A method according to claim 3, wherein other than during punching the first aperture in the line of apertures the guide pin passes through one of the punched apertures in the tube before engaging the guide recess, thereby to position the tube so that the next aperture will be provided at said predetermined distance from the previously punched aperture.

5. Apparatus for punching a line of apertures in tubes comprising:

(i) an elongated mandrel over which the tube to be punched can be passed;

(ii) a punch recess in said mandrel;

(iii) a punch die movable into said punch recess to punch an aperture in said tube;

(iv) drive means for moving the punch die into and out of said punch recess;

(v) displacing means for displacing the tube on said mandrel by a predetermined amount, whereby by repeated and sequenced operations of said drive means a line of apertures can be punched in said tube;

(vi) a punch head carrying said punch die;

(vii) a punch guide carried by said head and extending further from said head than said punch die;

(viii) a guide recess in said mandrel; said punch guide being spaced from said punch recess by said predetermined amount, whereby during each punching stroke, the punch guide enters the guide recess before the punch die enters the punch recess, ensuring the registry of the punch die and punch recess;

(ix) a guide box through which the mandrel passes and which is in the vicinity of the punch recess and guide recess; said guide box defining a passage through which the mandrel passes with sufficient clearance to receive the tube; said guide box including two gauge pins spaced by said predetermined amount, each gauge pin being slidable relative to the guide box into and out of contact with said mandrel for setting the positions of the first apertures to be punched in repsective faces of the tube.

6. Apparatus according to claim 5, wherein said mandrel is a square-sectioned elongated bar.

7. Apparatus according to claim 6, including:

(i) a framework supporting the mandrel in horizontal disposition; and (2) connection means connecting the mandrel pivotally at a rear end of the mandrel to a rear end of the framework for pivotal movement, the mandrel being otherwise disconnected from the framework so that the tube can be passed over the mandrel from the front end thereof.

8. Apparatus according to claim 7, wherein the drive means comprises a sleeve slidable on the mandrel, an endless flexible member to which the sleeve is securely connected, support wheels at the front and rear ends of the framework, and over which the endless flexible member is trained, a hand wheel, a gear transmission connecting the hand wheel and one of the support wheels whereby turning of the handwheel effects movement of the sleeve in the mandrel.

9. Apparatus according to claim 7, wherein said framework includes roller decking supporting said mandrel.

* * * * *